US006764375B1

(12) United States Patent
Hsu

(10) Patent No.: US 6,764,375 B1
(45) Date of Patent: Jul. 20, 2004

(54) ROTATABLE DECORATIVE-ARTICLE STRUCTURE

(76) Inventor: Lieh-Liang Hsu, No. 14, Alley 47, Lane 115, Sec. 2, Chenggong Rd., Neihu District, Taipei City, 114 (TW)

( * ) Notice: Subject to any disclaimer, the term of this patent is extended or adjusted under 35 U.S.C. 154(b) by 0 days.

(21) Appl. No.: 10/622,729

(22) Filed: Jul. 21, 2003

(51) Int. Cl.[7] ..... A63H 1/00

(52) U.S. Cl. ..... 446/236; 446/238; 446/265; 40/411; 40/414

(58) Field of Search ..... 446/236–238, 446/242, 243, 265; 40/411, 414, 430, 431, 433, 435, 456, 493, 547; 84/95.1, 95.2, 94.1, 94.2

(56) References Cited

U.S. PATENT DOCUMENTS 4,925,182 A * 5/1990 Hou ..... 472/6
5,078,386 A * 1/1992 Hou et al. ..... 472/7
5,203,743 A * 4/1993 Hou et al. ..... 472/7
5,640,791 A * 6/1997 Fong ..... 40/414
5,986,189 A * 11/1999 Yang ..... 84/95.2
6,582,273 B2 * 6/2003 Chen ..... 446/238

* cited by examiner

*Primary Examiner*—Derris H. Banks
*Assistant Examiner*—Bena B. Miller
(74) *Attorney, Agent, or Firm*—Rosenberg, Klein & lee

(57) ABSTRACT

A rotabable decorative-article structure including a rotating device connected with and supported by a base device is disclosed. The rotating device includes a fixed seat, a motor, a guiding cylinder and a rotating seat. The fixed seat includes a through opening and an annular slot with a guiding surface. The motor with a shaft is mounted on the fixed seat. The guiding cylinder is located inside the annular slot and includes a guiding wall to form a guiding track with respect to the guiding surface. The rotating seat is rotatably furnished in the annular slot, and includes a ring gear driven by the shaft of the motor and at least one guiding pillar with a guiding wheel sliding within the guiding track. The rotating seat is individually rotated, and the optical fibers and/or the wires separately go through the opening of the fixed seat. Therefore, the fiber decorations can be further used to decorate the rotatable decorative article.

9 Claims, 7 Drawing Sheets

ROTATABLE DECORATIVE-ARTICLE STRUCTURE

BACKGROUND OF THE INVENTION

1. Field of the Invention

The present invention relates generally to a rotatable decorative-article structure and, more particularly, to a rotatable decorative-article structure with individual rotating mechanism and separately passage for arranging the optical fibers and/or wires of the fiber decorations so that an enhanced dynamic performing effect can be provided.

2. Description of the Related Art

It is well-known a rotatable decorative article, such as a decorative carousel has a rotating mechanism for turning the decorative houses accompanying the music as a real carousel in an amusement park to entertain people.

However, this kind of decorative carousel showing merely a dynamic and musical effect is not attractive to people any more.

The optical fiber is popular used among the electronic products. For the decorative articles, optical fiber can provide a colorful lighting effect to enhance the value.

However, a fiber decoration cannot fit to the conventional rotatable decorative article because a rotating mechanism of the rotatble decorative article and the fibers and/or the wires arrangement will interfere with each other. The rotation of the conventional rotatable decorative article will make the fibers and/or the wires to twist together.

BRIEF SUMMARY OF THE INVENTION

To achieve these and other advantages and in order to overcome the disadvantages of the conventional method in accordance with the purpose of the invention as embodied and broadly described herein, the present invention provides a rotatable decorative-article structure with an individual rotating mechanism capable of using the fiber decorations and preventing the optical fibers and/or the wires from twisting together.

The other object of the present invention is to provide a rotatable decorative-article structure with an individual rotating mechanism having an effective and precise operation.

Still the other object of the present invention is to provide a rotatable decorative-article structure with a dynamic and colorful performing effect to enhance the value.

According to the above-mentioned objects, the rotabable decorative-article structure of the present invention including a rotating device connected with and supported by a base device is disclosed. The rotating device includes a fixed seat, a motor, a guiding cylinder and a rotating seat. The fixed seat includes a through opening and an annular slot with a guiding surface. The motor with a shaft is mounted on the fixed seat. The guiding cylinder is located inside the annular slot and includes a guiding wall to form a guiding track with respect to the guiding surface. The rotating seat is rotatably furnished in the annular slot, and includes a ring gear driven by the shaft of the motor and at least one guiding pillar with a guiding wheel sliding within the guiding track. The rotating seat is individually rotated, and the optical fibers and/or the wires separately go through the opening of the fixed seat.

The fixed seat further includes a cavity with an orifice going through the annular slot. The guiding surface is a waved surface and the guiding track is also a waved track.

The rotating seat further includes at least one pillar hole for receiving the guiding pillar. The guiding pillar has a L-shaped plate formed on the top end thereof, and the guiding wheel is located on the L-shaped plate. The motor further includes a gear on the shaft for engaging with the ring gear.

The base device includes a decorative base housing with a supporting portion extending upward to connect to the opening of the fixed seat. The rotating device further includes a decorative top housing, and a fiber decoration on the top housing. Furthermore, the base device comprises a motor, a light source and a speaker mounted on a base plate, and the motor connects a transparent color plate located above the light source.

These and other objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION OF THE INVENTION

Figure 1:
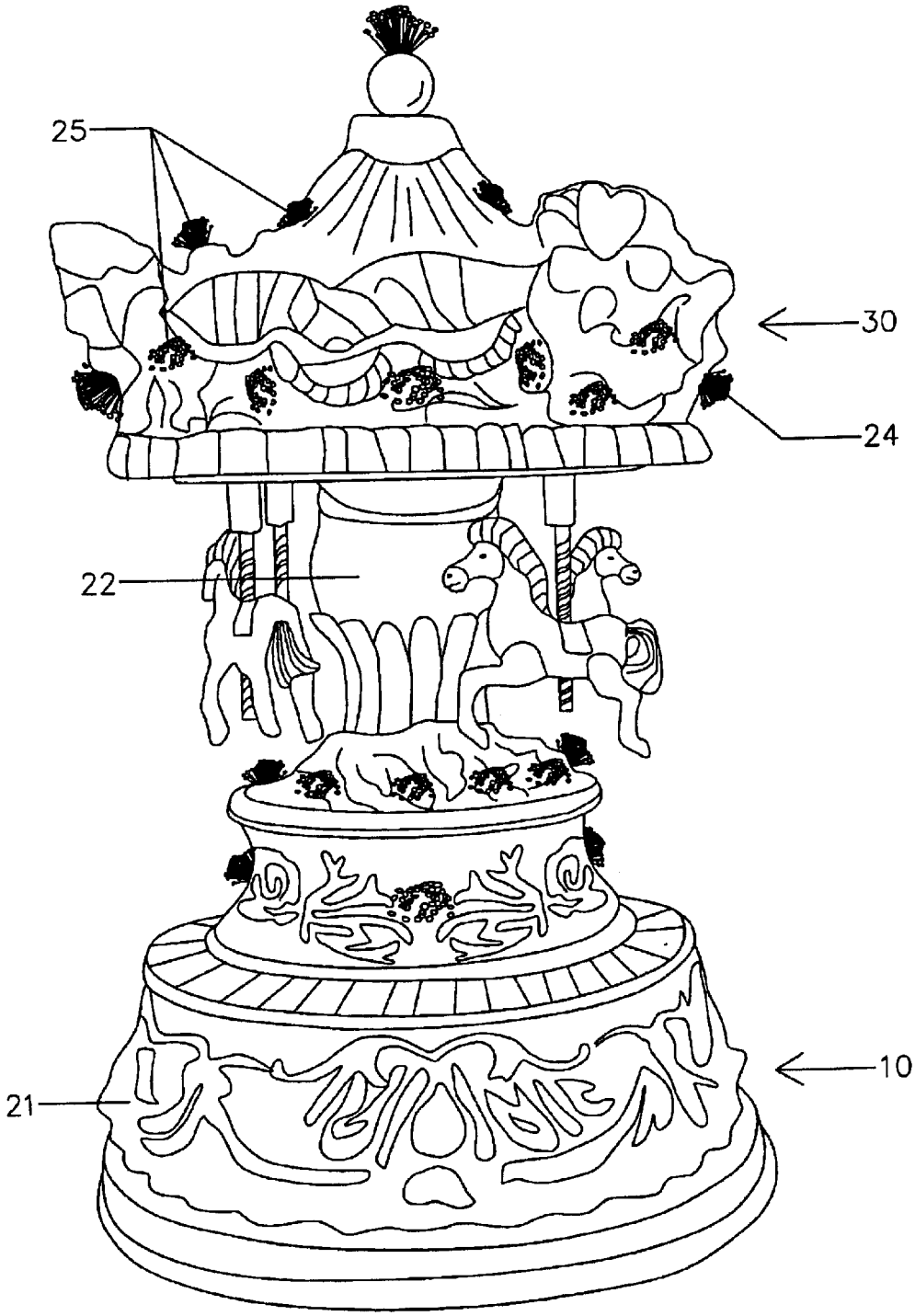
FIG. 1 is a perspective view illustrating a rotatable decorative article according to the present invention.
Figure 2:
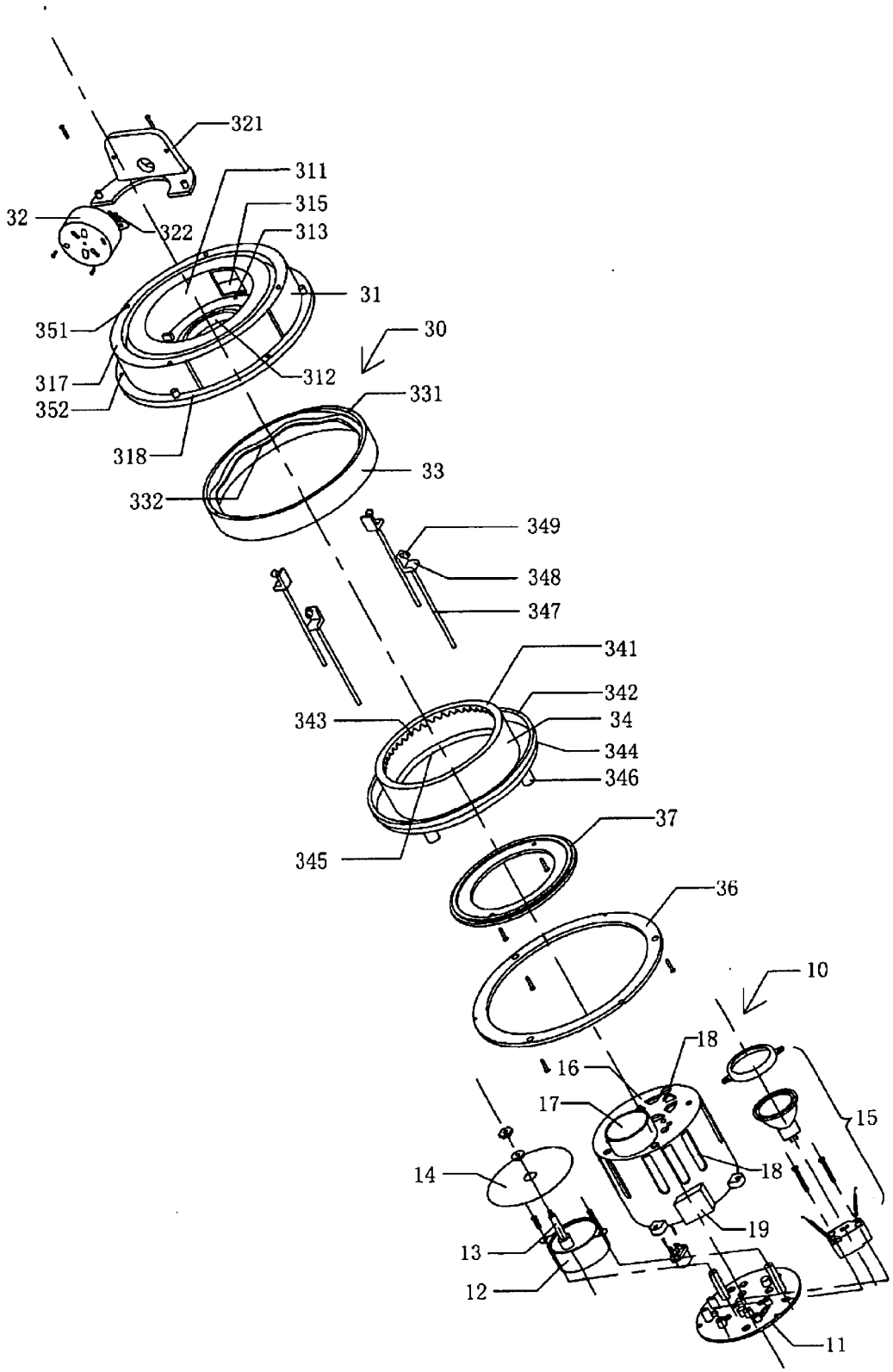
FIG. 2 is an exploded view illustrating a rotatable decorative-article structure according to a preferred embodiment.

Reference will now be made in detail to the preferred embodiments of the present invention, examples of which are illustrated in the accompanying drawings. Wherever possible, the same reference numbers are used in the drawings and the description to refer to the same or like parts.

Refer to FIGS. 1–7, the present invention is disclosed by illustrating a decorative article of the carousel 1 as a preferred embodiment, including a base device 10 and a rotating device 30. The base device 10 further includes a base plate 11, a motor 12, a transparent color plate 14, a light source 15 and a cover 16. The motor 12 is mounted on the base plate 11 and has a shaft 13 connected to the transparent color plate 14. The transparent color plate 14 includes different colored portions and is rotated by the shaft 13. The light source 15 is mounted under the transparent color plate 14 and emits light toward the rotating transparent color plate 14 so that a colorful light effect can be achieved. The cover 16 is mounted over the base plate 11 and includes an opening 17 for conducting the light emitting and the fibers and/or the wire arrangement. The top and circumferential surfaces of the cover 16 can further include a plurality of holes or slots 18 for the same reason. Furthermore, a speaker 19 can be mounted on the cover 16 or ,as in another embodiment, on the base plate 11 for providing the music and sound.

The base device 10 further includes a decorative base housing 21 for containing the assembly of the base plate 11, the cover 16 and etc., therefore the carousel can provide a beautiful appearance. The base housing 21 includes a support portion 22 for supporting the rotating device 30.

Figure 3:
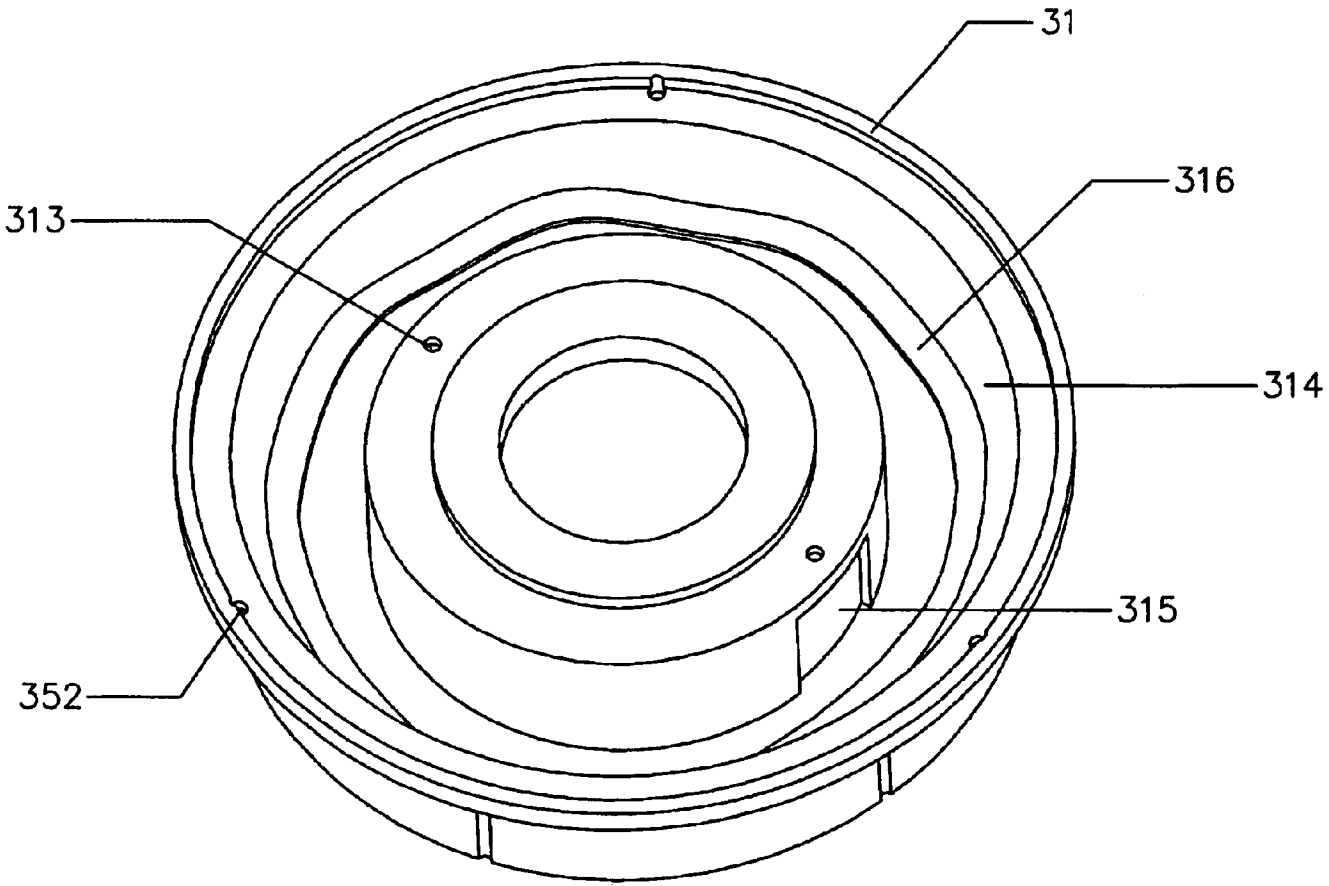
FIG. 3 is a perspective view of reversing a fixed seat in FIG. 2.
Figure 4:
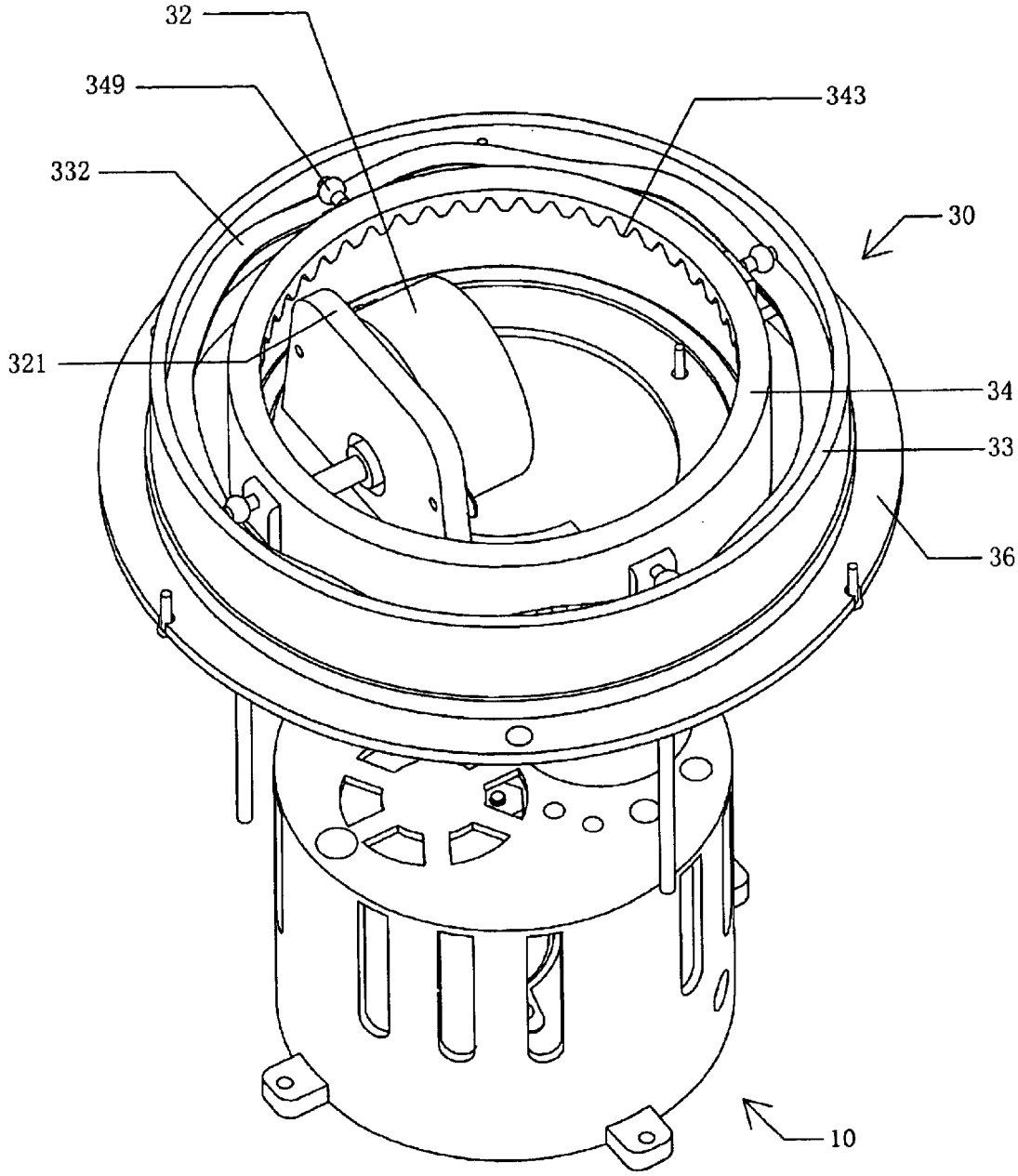
FIG. 4 is a perspective view illustrating the assembly without the fixed seat in FIG. 2.
Figure 6:
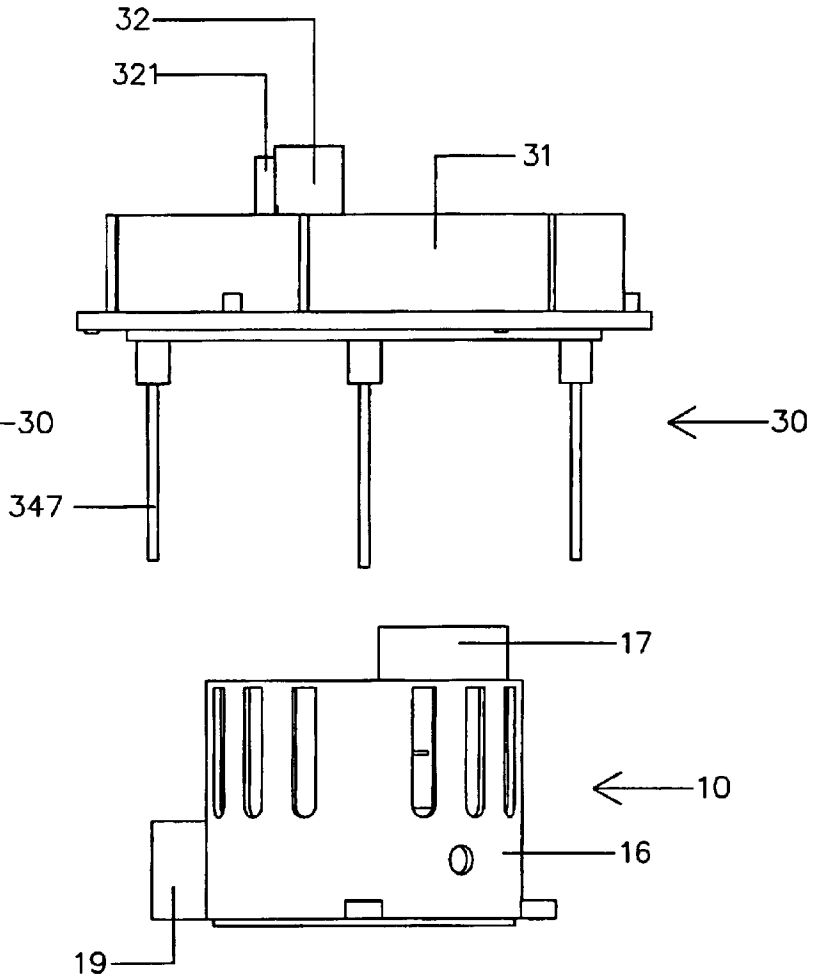
FIG. 6 shows a side view of a base device and a rotating device according to the preferred embodiment.
Figure 5:
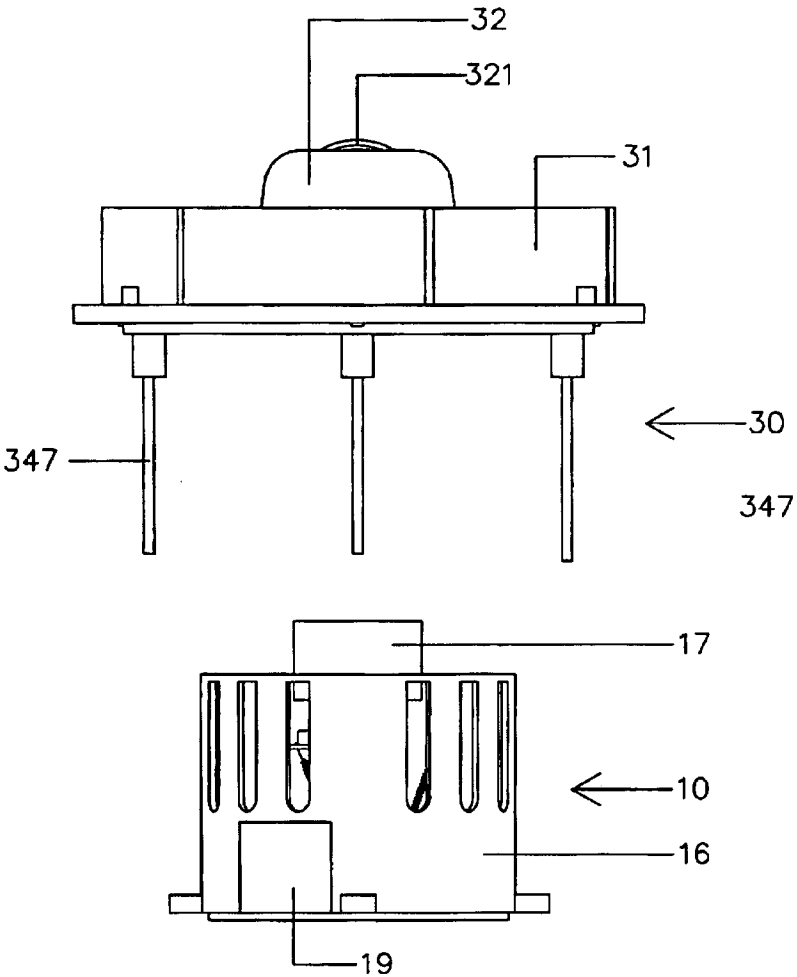
FIG. 5 shows a front view of a base device and a rotating device according to the preferred embodiment.
Figure 7:
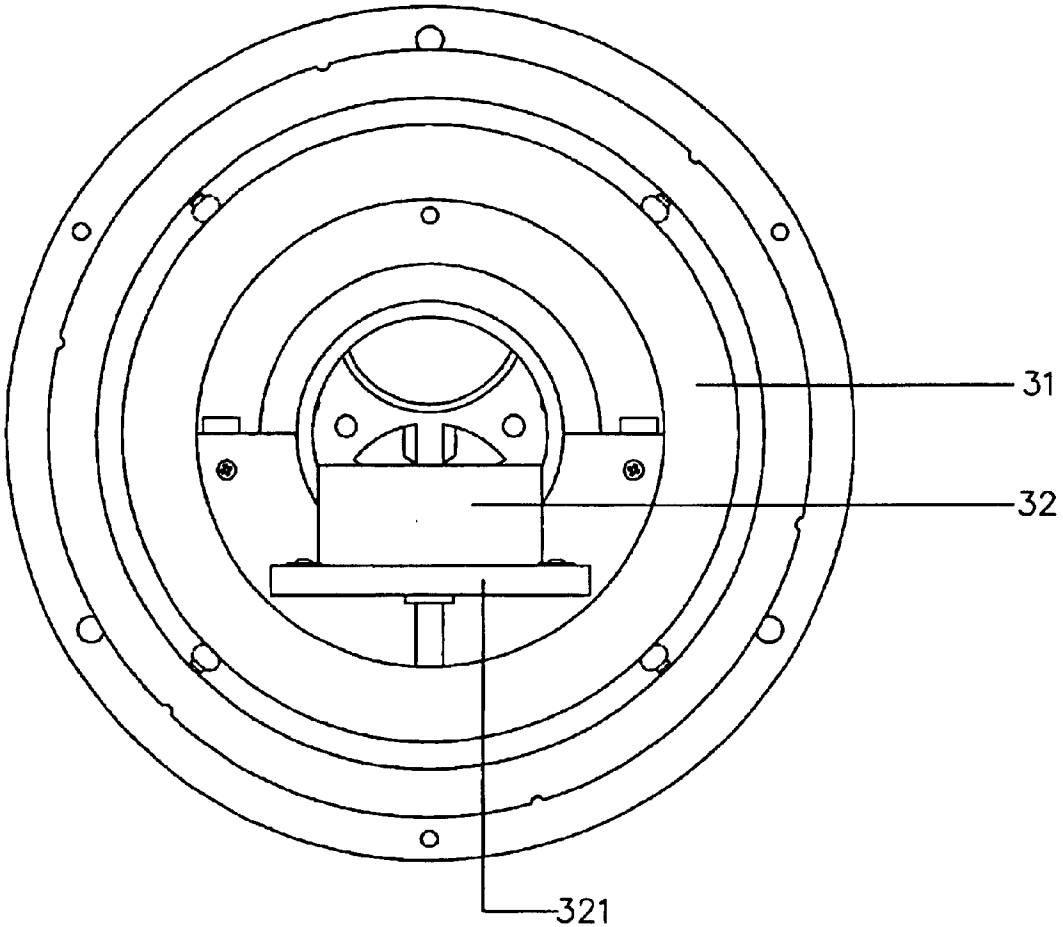
FIG. 7 shows a top view of the assembly in FIG. 2.

The rotating device 30 includes a fixed seat 31, a motor 32, a guiding cylinder 33 and a rotating seat 34. The fixed seat 31 has a cavity 311 on the top surface and a through opening 312 inside the cavity 311. There are a plurality of screw holes 313 on the bottom surface of the cavity 311. The opening 312 is for the support portion 22 of the base housing 21 to connect the rotating device 30, and provides a separate passage for arranging the optical fibers and/or wires. In the bottom of the fixed seat 31 forms an annular slot 314 (as shown in FIG. 3) and an orifice 315 goes through between the annular slot 314 and the cavity 311. There is a waved guiding surface 316 formed in the annular slot 314. Furthermore, a plurality of screw holes 351, 352 are formed on the top surface 317 and the bottom ring surface 318 of the fixed seat 31.

The motor 32 is fixed near the location of the orifice 315 in the cavity 311 by a motor seat 321. A gear 322 connected to the motor 32 is located in the annular slot 314.

The guiding cylinder 33 has a plurality of screw holes 331 on the top surface thereof, and a waved guiding wall 332 on the inner surface thereof. By fixing through the corresponding screw holes 351 and 331 of the guiding cylinder 33 and the fixed seat 31, respectively, the guiding cylinder 33 can be put into the annular slot 314 to mount on the fixed seat 31. Meanwhile, there is a waved guiding track formed between the guiding surface 316 and the respective guiding wall 332.

The rotating seat 34 includes a sleeve 341 and a disk 342. The sleeve 341 has a ring gear 343 at the inner side thereof. The outer circle and the inner circle of the disk 342 include the fixing loops 344 and 345, respectively. The sleeve 341 of the rotating seat 34 is located inside the annular slot 314. An outer ring 36 and an inner ring 37 are used to uphold against the fixing loops 344 and 345 of the rotating seat 34 to fix on the fixed seat 31 through the screw holes 314 and 352, respectively. Therefore, the rotating seat 34 is held and is rotatable with respect to the fixed seat 31. Furthermore, there are a plurality of pillar holes 346 formed on the disk 342. A guiding pillar 347 is penetrated into each pillar holes 346 up from the disk 342. Each guiding pillar 347 has a L-shaped plate 348 and a guiding wheel 349. The L-shaped plate 348 is fixed on the outer circumferential surface of the sleeve 341 of the rotating seat 34, and the guiding: wheel 349 is sitting on the guiding wall 332 of the guiding cylinder 33.

Figure 8:
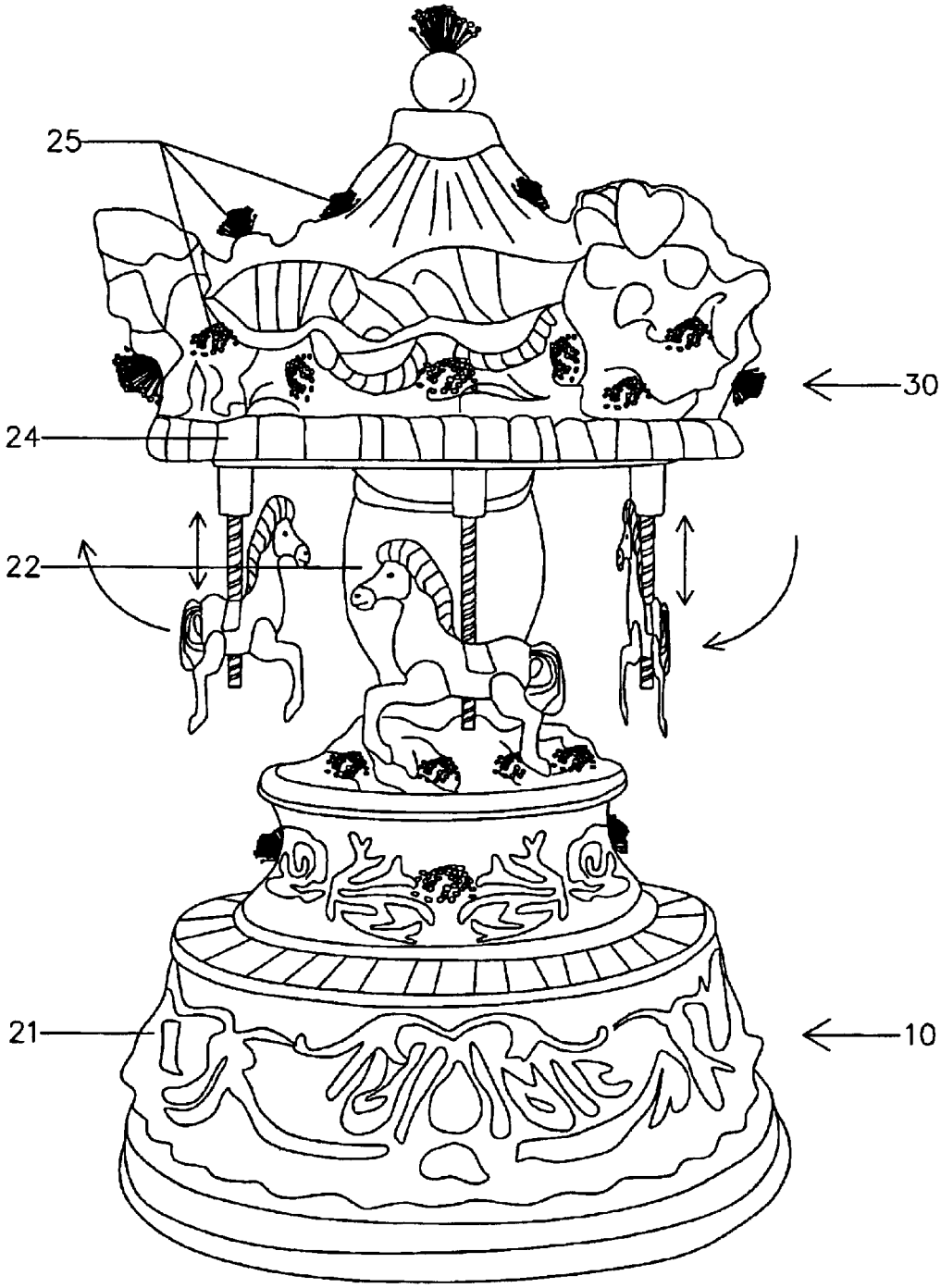
FIG. 8 is a perspective view illustrating the rotation of the decorative article according to the present invention.

After the assembly of the rotating device 30, the gear 322 is engaged with the ring gear 343. As such, the motor 32 will drive the rotating seat 34 to rotate and the pillars 347 will move up and down while the guiding wheels 349 are sliding within the waved guiding track formed between the guiding surface 316 and the guiding wall 332. As shown in FIG. 8, when a decorative house 23 is connected to each end of the pillars 347, the decorative houses 23 will rotate around and move up and down like the carousel.

Furthermore, the rotating device 30 includes a decorative top housing 24. A plurality of fiber decorations 25 is decorated on the top housing 24. By using different combination of optical fibers, the decorations 25 can provide a brilliant decorating effect. Therefore, a dynamically lightful decorative article of the present invention is provided.

In the present invention, the reason that the fiber decorations 25 can be furnished on the top housing 24 is because the rotating seat 34 is individually rotated, and the optical fibers and/or the wires separately go through the opening 312 of the fixed seat 31. As such, the rotating mechanism including the gear 322 and the rotating seat 34 is operated without interference from the fiber and/or wire arrangement.

It will be apparent to those skilled in the art that various modifications and variations can be made to the present invention without departing from the scope or spirit of the invention. In view of the foregoing, it is intended that the present invention cover modifications and variations of this invention provided they fall within the scope of the invention and its equivalent.

What is claimed is:

1. A rotatable decorative-article structure comprising a rotating device connected with and supported by a base device, the rotating device further comprising:

a fixed seat including a through opening and an annular slot with a guiding surface;

a motor with a shaft mounted on the fixed seat;

a guiding cylinder located inside the annular slot, including a guiding wall to form a guiding track with respect to the guiding surface; and a rotating seat rotatably furnished in the annular slot, including a ring gear driven by the shaft of the motor, and at least one guiding pillar with a guiding wheel sliding within the guiding track.

2. The rotatable decorative-article structure of claim 1 wherein the fixed seat further includes a cavity with an orifice going through the annular slot.

3. The rotatable decorative-article structure of claim 1 wherein the guiding surface is a waved surface.

4. The rotatable decorative-article structure of claim 1 wherein the rotating seat further includes at least one pillar hole for receiving the guiding pillar.

5. The rotatable decorative-article structure of claim 1 wherein the guiding track is a waved track.

6. The rotatable decorative-article structure of claim 1 wherein the motor further includes a gear on the shaft for engaging with the ring gear.

7. The rotatable decorative-article structure of claim 1 wherein the rotating device further comprises a decorative top housing, and a fiber decoration on the top housing.

8. The rotatable decorative-article structure of claim 1 wherein the guiding pillar has a L-shaped plate formed on the top end thereof, and the guiding wheel is located on the L-shaped plate.

9. The rotatable decorative-article structure of claim 1 wherein the base device comprises a motor, a light source and a speaker mounted on a base plate, and the motor connects a transparent color plate located above the light source.

* * * * *